US005150936A

United States Patent [19]

Avery

[11] Patent Number: 5,150,936

[45] Date of Patent: Sep. 29, 1992

[54] GRAPPLE ASSEMBLY FOR ATTACHMENT TO WORKHEAD

[76] Inventor: Neal H. Avery, P.O. Box 348, West Concord, Minn. 55985

[21] Appl. No.: 645,184

[22] Filed: Jan. 17, 1991

[51] Int. Cl.[5] ..... B66C 3/04

[52] U.S. Cl. ..... 294/104; 294/3; 294/88; 414/740; 414/912

[58] Field of Search ..... 294/2, 3, 68.23, 86.4, 294/88, 104-107, 902; 30/134; 37/117.5, DIG. 3, DIG. 12; 414/607, 608, 722-724, 729, 738-740, 912, 920

[56] References Cited

U.S. PATENT DOCUMENTS

| | | | |
|---|---|---|---|
| 3,275,172 | 9/1966 | Smith . | |
| 3,802,731 | 4/1974 | LaBounty | 294/104 X |
| 3,933,389 | 1/1976 | Korbel | 294/88 |
| 3,964,778 | 6/1976 | Jouppi | 294/88 |
| 4,012,069 | 3/1977 | Carson | 294/68.23 |
| 4,017,114 | 4/1977 | LaBounty | 294/88 |
| 4,104,792 | 8/1978 | LaBounty | 414/739 X |
| 4,248,471 | 2/1981 | LaBounty | 294/88 |
| 4,268,217 | 5/1981 | Perreault et al. | 294/104 X |
| 4,426,110 | 1/1984 | Mitchell et al. | 294/88 |
| 4,519,135 | 3/1985 | LaBounty | 414/740 X |
| 4,542,929 | 9/1985 | Passinger | 294/88 |
| 4,558,515 | 12/1985 | LaBounty | 294/104 X |
| 4,818,005 | 4/1989 | Purser | 294/88 |
| 4,907,356 | 3/1990 | La Bounty | 294/68.23 X |
| 5,024,397 | 6/1991 | Edwards et al. | 294/68.23 |

*Primary Examiner*—Johnny D. Cherry
*Attorney, Agent, or Firm*—Jacobson & Johnson

[57] ABSTRACT

A quick connect grapple attachment including a first grapple jaw that attaches to one jaw of a work head and a second grapple jaw that attaches to another jaw of a workhead with the first grapple jaw and the second grapple jaw pivotally connect to each other so that an operator can grasp and lift articles using the controls of the jaws of the workhead.

15 Claims, 2 Drawing Sheets

GRAPPLE ASSEMBLY FOR ATTACHMENT TO WORKHEAD

FIELD OF THE INVENTION

This invention relates generally to an attachment device and more specifically to a grapple attachment device for quickly connecting to the jaws of a workhead to convert the workhead into a grapple where the opening and closing of the jaws of the workhead provide the sole means for opening and closing the jaws on the grapple.

BACKGROUND OF THE INVENTION

The concept of workheads such as hydraulic demolition shears that are mounted to the boom of a mobile power unit to cut chunks of scrap metal into smaller pieces are well known in the art. Typically, such demolition shears are used to cut items such as iron pipes, steel pipes, rods, sheets, plate, beams, and other structures. The hydraulic shear is both effective and efficient in cutting larger materials into smaller pieces. However, after the material is cut, the shear jaws are relatively inefficient and clumsy for picking up the smaller pieces and loading the cut materials onto a truck. Attempts have been made to make assemblies that contain both shear jaws and grapple jaws. Such assemblies often involve a sacrifice of performance of both the shear and the grapple. Preferably a grapple attachment should be used to pick up the smaller pieces. Since it is also expensive to have a separate vehicle with a grapple to load material, it would be advantageous if one could quickly attach a grapple to the jaws of a demolition shear so the operator of the power unit could then use the grapple to pick up material located on the ground.

The present invention provides a grapple attachment that can be quickly attached to to a workhead such as the jaws of a demolition shear to allow the operator to transfer the learned touch and feel of operating the workhead to operation of a grapple attachment.

DESCRIPTION OF THE PRIOR ART

The U.S. Pat. No. 4,519,135 shows a metal demolition shear having an upper jaw that pivots downward through a double lower jaw to sever an article located between the jaws. A set of hydraulic cylinders operates the movable jaw to permit an operator to cut larger pieces into smaller chunks.

The U.S. Pat. No. 4,104,792 shows a wheel and tire cutter that includes a cutter jaw that is attached to the back of a grapple jaw.

The U.S. Pat. No. 4,248,471 shows a backhoe grapple member with two movable grapple jaws.

The U.S. Pat. No. 4,818,005 shows a grapple jaw where both jaws are opened and closed by a single hydraulic cylinder.

The U.S. Pat. No. 4,558,515 shows a combination metal shear and grapple hook where both the grapple and shear functions are performed with the same jaws.

The U.S. Pat. No. 4,017,114 shows a multidirectional grapple where the grapple head can be rotated to the proper position to pick up material.

The U.S. Pat. No. 3,275,172 shows a wrecking and loading tool that contains a cutting hook on one jaw of a grapple-like member.

The U.S. Pat. No. 3,964,778 shows a grapple including a hydraulic ram connected to each of the jaws to pivot the jaws together or apart.

The U.S. Pat. No. 4,426,110 shows a hydraulic grapple that has a rotating support head.

The U.S. Pat. No. 3,933,389 shows a grapple tongs with grapple jaws that can cradle an object from underneath.

The U.S. Pat. No. 4,542,929 shows an articulating clam type grapple for a backhoe with the grapple including a hydraulic motor and gear box for rotating the grapple such that the grapple and the jaws are positively controlled in all directions.

The U.S. Pat. No. 3,802,731 shows a grapple assembly for a backhoe.

BRIEF SUMMARY OF THE INVENTION

Briefly, the invention comprises a grapple attachment including a first grapple jaw that attaches to one jaw of a work head and a second grapple jaw that connects to another jaw of a workhead. The first grapple jaw and the second grapple jaw pivotally connect to each other so that an operator can grasp and lift articles with the grapple attachment. Another feature of the invention is that the controls of the jaws of the workhead are the same controls the operator uses to either close or open the grapple jaws. A jawstop prevents an operator from accidently overpowering the grapple attachment.

DESCRIPTION OF THE PREFERRED EMBODIMENT

Figure 1:
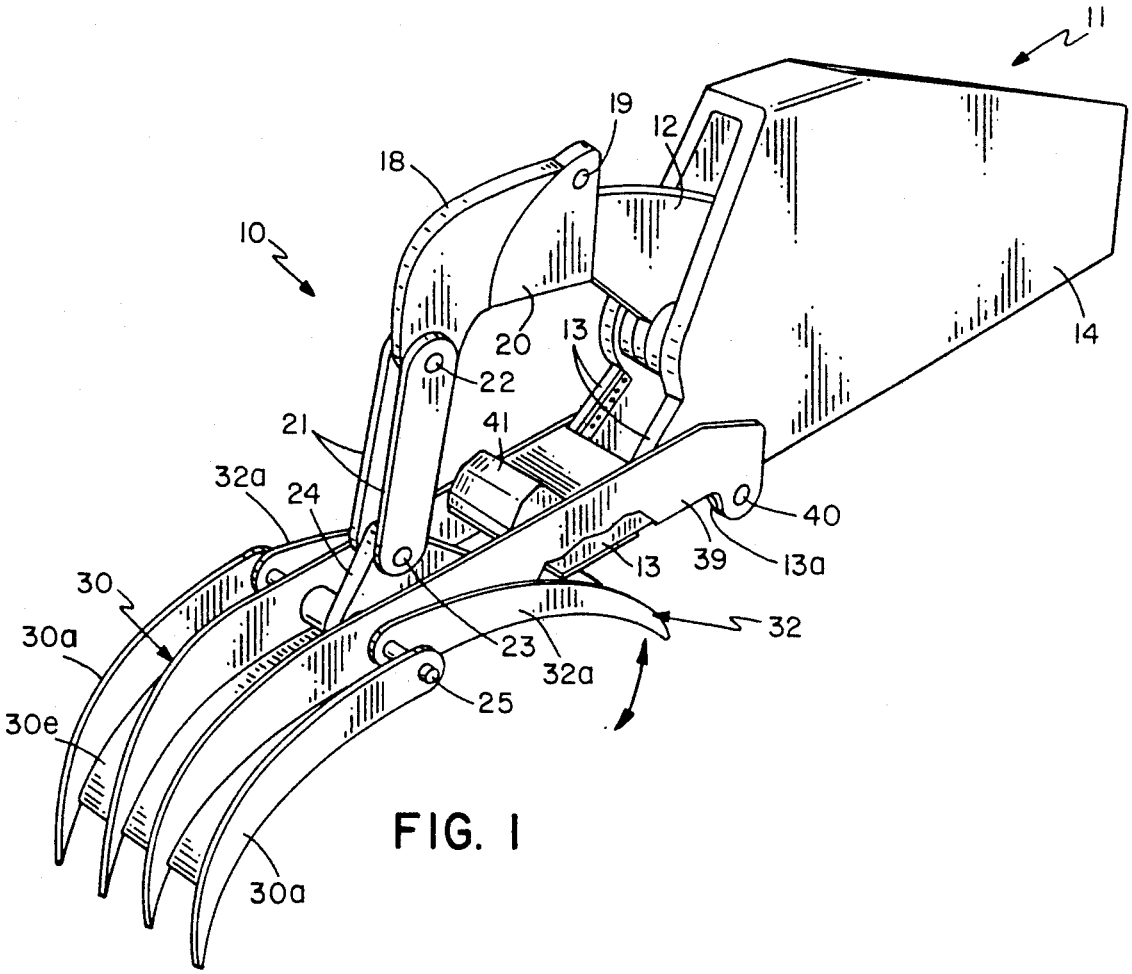
FIG. 1 shows my grapple attachment mounted on the jaws of a demolition shear.
Figure 3:
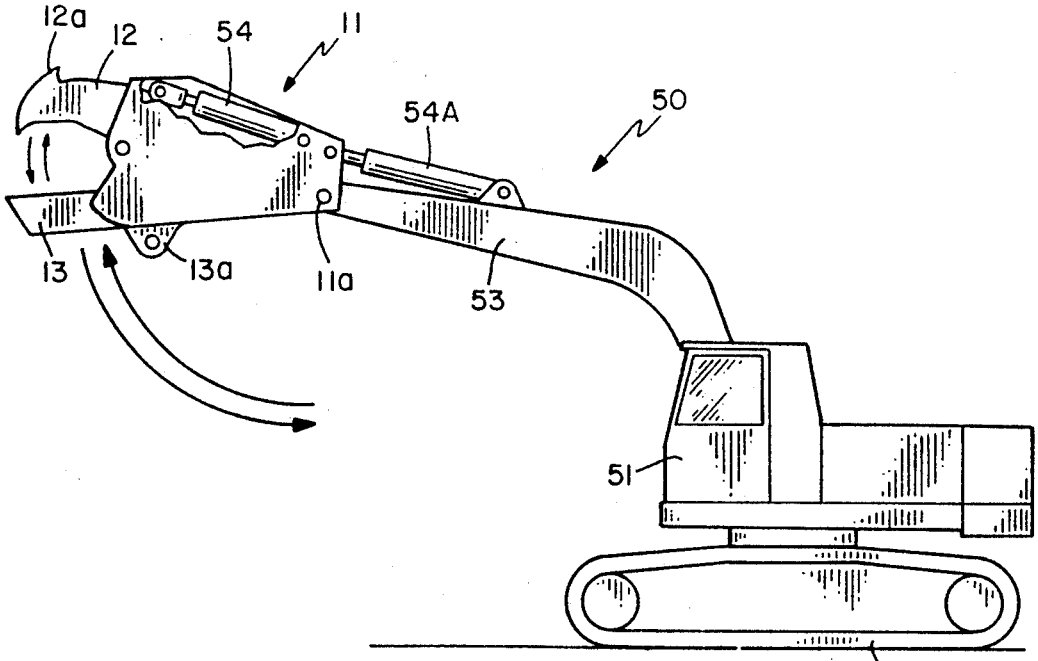
FIG. 3 (PRIOR ART)
FIG. 3 shows a mobile demolition shear.

Referring to FIG. 1 and FIG. 3, reference numeral 10 generally identifies a grapple attachment connected to the jaws of a workhead 11. Typically, workhead 11 comprises a demolition shear having an upper cutting jaw 12 that pivots counterclockwise through a fixed lower double jaw 13 to permit an operator to sever articles located between cutting jaw 12 and double jaw 13. Such a demolition shear is more fully shown and described in U.S. Pat. No. 4,519,135. The jaws of the workhead 11 can be opened and closed with hydraulic controls located in a mobile power unit. FIG. 3 shows a mobile power unit 50 with demolition shear workhead 11 mounted on the end of a boom 53 that can be raised or lowered by an operator in cab 51. Located on one end of boom 53 is an operator controllable two way hydraulic cylinder 54 for opening and closing upper shear jaw 12 and an operator controllable two way hydraulic cylinder **54*a* for pivoting workhead 11 about pin 11*a***.

The grapple attachment 10 comprises a first member 18 having a sleeve or pocket 20 for extending partially and snugly around upper jaw 12 of demolition shear 11. Sleeve 20 includes quick connect means such as a pin 19 for extending through an opening in sleeve 20 and behind the back of a fin **12*a* (see FIG. 3) extending upward from upper shear jaw 12. The combination of pin 19 and sleeve 20 coact to securely hold upper shear jaw 12 and sleeve 20 in a fixed working relationship as jaw 12 is opened and closed. Thus, a feature of the invention is that the mating fit between sleeve 20 and jaw 12 permits a single pin to securely hold sleeve 20 in a fixed working relationship on movable upper shear jaw 12**.

Connected to lower double jaw 13 is a second member 39 having a sleeve for extending partially and snugly around lower fixed shear jaw 13. Member 39 also includes quick connect means such as a pin 40 that extends through member 39 and a link member 13*a* (see FIG. 3) on the underside of shear jaw 13. The mating or pocket like fit of jaw 13 in the sleeve in member 39 permits pin 40 to securely hold lower shear jaw 13 and sleeve 39 in a fixed working relationship as jaw 12 is opened or closed. Thus, a further feature of the invention is that only two pins are needed to hold grapple attachment 10 on shear jaws 12 and 13. That is, pin 19 and pin 40 constitute the sole means for preventing grapple attachment 10 from falling off workhead 11. More specifically, the coaction of sleeve 20 and shear jaw 12 prevents rearward and lateral movement of the upper portion of grapple attachment 10 while pin 19 prevents withdrawal of shear jaw 12 from sleeve 20. Likewise, the lower jaw 13 and sleeve 39 coact to prevent rearward and lateral movement of the lower portion of jaw attachment 10 while pin 40 prevents withdrawal of shear jaw 13 from member 39.

In order to prevent the operator from accidently overpowering the grapple attachment, particularly when there is no material in the grapple attachment, I provide lower shear jaw 13 with a jaw stop bar 41. Jaw stop 41 is made of a hard material to prevent the upper shear jaw 12 from closing too far and thus damaging the grapple jaws when there is no material in the grapple jaws. That is, the placement and hardness of jaw stop 41 is such that the jaws of the shear could not sever the jawstop 41. Consequently, should the operator apply too much closing force to the grapple attachment, the operator is ensured that one could not overpower and cut the grapple attachment 10. If material is located in the grapple jaws, the normal touch and feel of the controls to the workhead allow the machine operator to control the grasping pressure on material in the grapple jaws. Thus, a feature of this invention is that the operator does not have to develop a new touch and feel for the controls of the grapple attachment since the same controls are used for both the workhead and the grapple attachment. In addition to jawstop 41, the workhead 11 includes an internal stop (not shown) that limits the opening of the upper jaw 12. In the present invention, the grapple attachment 10 is designed so that when the jaw 12 is fully opened, the grapple jaw 30 is also fully opened. Consequently, should the operator apply too much opening force to the hydraulic cylinder, the operator is ensured that one could not overpower and damage the grapple jaw 30. Thus, a feature of the invention is that when the workhead jaw is fully open, the grapple jaws are fully opened and when the workhead jaws engage the jawstop, the grapple jaws are fully closed. Consequently, the present invention not only retains the touch and feel of the workhead but it also retains the fully opened limits of movement of the workhead.

The grapple attachment 10 includes a first fixed grapple jaw 30 connected to member 39. Grapple jaw 30 includes four curved tines 30*a* having a curved backing plate 30*e* located on the inside of the grapple jaw 30. The purpose of the curved tines is to permit the tines to be able to cradle loose material. Although four tines are shown in grapple jaw 30, more or less tines could be used in either grapple jaw 30 or grapple jaw 32. In the embodiment shown, jaw 30 is fixedly mounted to lower shear jaw 13 and faces toward an operator controlled workhead 11. By having grapple jaw 30 with back plate 30*e* facing the operator located in a machine cab, it allows the operator to see the material that the grapple attachment is about to engage. A reference to FIG. 3 indicates that an operator sitting in cab 51 can clearly see the underside of workhead 11. Consequently, the positioning of my grapple attachment with downward facing grapple jaw 30 facing toward the machine operator permits a machine operator to see the material being loaded into the grapple jaws. It also permits an operator to see the inside of the grapple when the grapple jaws are fully opened.

Pivotally connected to fixed grapple jaw 30 is a pivotable grapple jaw 32 having a plurality of open tines 32*a*. A pivot bar 24 fixedly connects to pivot rod 25 to rotate pivot rod 25 and tines 32*a*. Pivotally connected to pivot bar 24 by a pivot pin 23 is one end of a double link 21. The other end of double link 21 pivotally connects to member 18 through a pivot pin 22. The pivotal connection of grapple jaw 32 to grapple jaw 30 enables an operator to use the hydraulic controls of the workhead 11 and the linkage between the grapple jaws and the shear jaws to open and close grapple jaws 30 and 32. That is, counter-clockwise movement of first shear jaw 12 toward lower shear jaw 13 moves member 18 downward and causes grapple jaw 32 to pivot clockwise toward grapple jaw 30 to enable an operator to pick up an article located between grapple jaw 30 and grapple jaw 32 solely through the movement of shear jaw 12 toward lower jaw 13.

Figure 2:
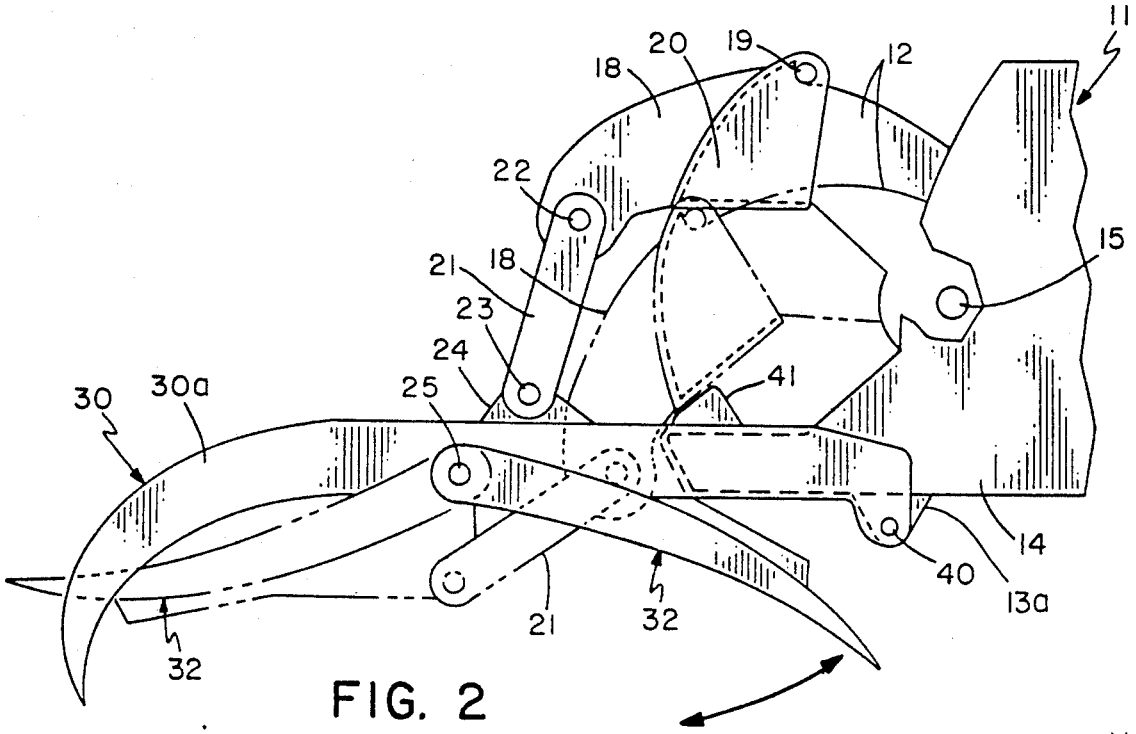
FIG. 2 shows my grapple attachment in the open position.

In order to illustrate the movement and coaction of upper shear jaw 12 and lower grapple jaw 32, reference should be made to FIG. 2 which shows grapple jaw 32 in the open position (solid lines) and grapple jaw 32 in the closed position (dashed lines). Note the counter-clockwise pivoting of shear jaw 12 about pivot pin 15 causes double link 21 and member 23 to pivot downward to push grapple jaw 32 toward the closed position. Likewise, the clockwise pivoting of upper jaw 12 causes lower grapple jaw 32 to open and release any material held therein. Thus, not only do the same controls open and close grapple jaws 30 and 32, but the opening and closing of shear jaws 12 and 13 also corresponds to the opening and closing of grapple jaws 32 and 30. In the preferred embodiment, the length of the grapple jaw tines are identical so that when the grapple jaws are closed, the tips of the tines can be used to pick up small pieces of material in a pincer like action.

Referring to FIG. 3, reference numeral 50 identifies a typical mobile power unit 50 having a cab 51 for an operator. A set of endless tracks 52 allows the operator to move mobile unit 50 about. An arm or boom 53 extends outward to work head 11 that contains an upper jaw 12 with a fin 12*a* and a lower jaw 13 having a ring 13*a* extending outward therefrom. Ring 13*a* and fin 12*a* are used to pin grapple attachment 10 to workhead 11. A hydraulic cylinder 54A mounts to boom 53 to permit an operator sitting in machine cab 51 to raise and lower grapple attachment head. A hydraulic cylinder 54 permits an operator to hydraulically control the opening and closing of shear jaws 12 and 13 with a set of hydraulic controls (not shown). Likewise, additional controls allow an operator to move boom 53 to a position where workhead 11 is proximate the article to be cut. While jaw 12 contains a fin 12*a*, it is envisioned that if jaw 12 did not contain a fin or the like, one could be welded on jaw 12 to hold sleeve 20 on jaw 12. Likewise, if workhead 11 did not contain a loop 13*a*, one could weld a member on workhead 11 to permit an operator to connect lower member 39 thereto.

As can be seen from the embodiment shown in FIG. 2, the grapple attachment opening and closing operations are completely derived from the motion of the upper shear jaw 12. This is advantageous since no additional hydraulic lines or cylinders are needed to connect grapple attachment 10 to workhead 11. Since the opening of the shear jaws causes the grapple jaws to open, it is also easy for an operator to learn to open and close the grapple jaws since the hydraulic controls for opening and closing shear jaws 12 and 13 are identical to the motion required to open and close grapple jaws 30 and 32. Thus, a feature of my invention is that with the use of two pins I can quickly connect a grapple attachment to the jaws of a shear without having to separately connect the hydraulic controls of the shear to the grapple attachment.

Figure 4:
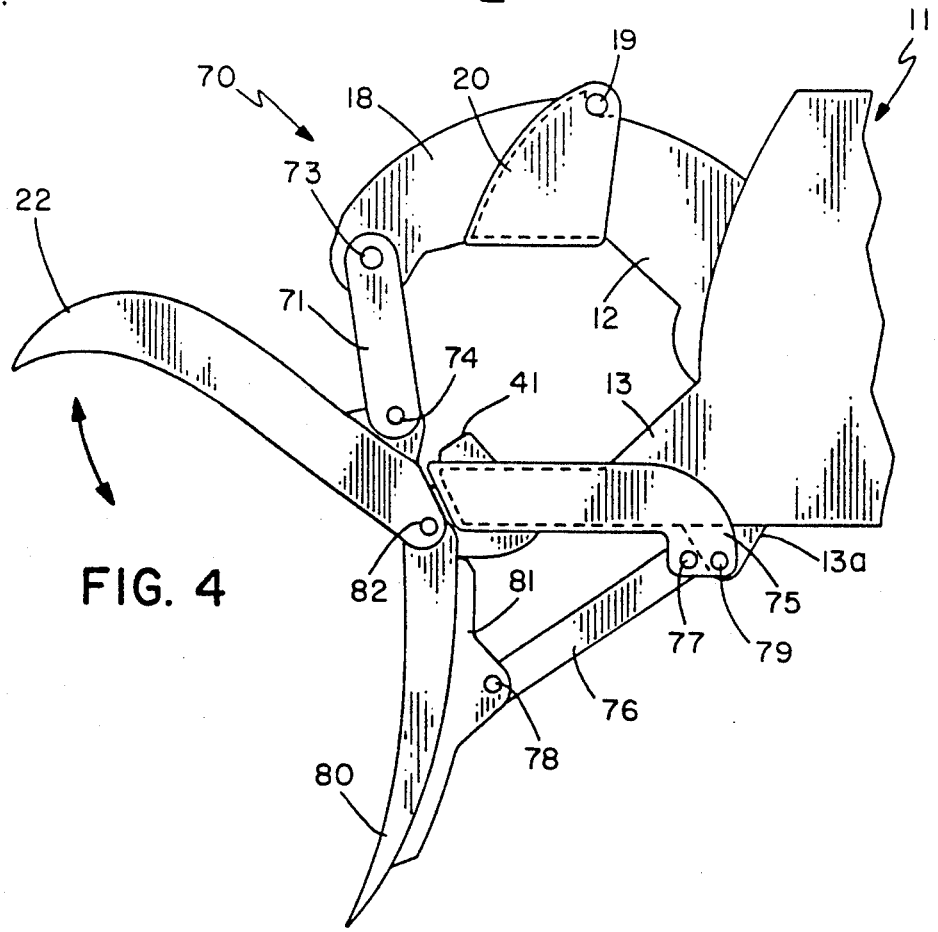
FIG. 4 shows an alternate embodiment of a grapple attachment in the open position.

FIG. 4 shows an alternate embodiment of my invention identified by reference numeral 70. Grapple attachment 70 differs from grapple attachment 10 in that the far jaw 22 of grapple attachment 70 is movable and the jaw 80 nearest to the operator is fixed. Grapple attachment 70 contains a fixed lower grapple jaw 80 with a brace 76 that connects grapple jaw 80 to lower shear jaw 13. A pin 78 extends through one end of brace 76 and back plate 81 and a second pin 77 extends through sleeve 75 that extends around lower shear jaw 13. Upper grapple jaw 22 pivots about a pivot pin 82 extending through grapple jaw 22. A link 71 pivotally connects to member 18 through pivot pin 73. Sleeve 20 is secured to top shear jaw 12 so that the opening and closing of shear jaw 12 causes upper grapple jaw 22 to open and close.

The embodiment of FIGS. 1 and 2 allows the operator to see the material that is being picked up by the grapple while the embodiment of FIG. 4 may obscure material being grasped by grapple jaws 22 and 80. However, in some applications it is not necessary for the machine operator to see the material as the grapple grasps the material between its jaws. In such applications, the embodiment of FIG. 4 where the lower jaw may obscure the article being picked up can be used. Thus, my invention can be used to move either a movable far or near grapple jaw.

Another feature of my invention is that it extends the reach of a conventional workhead since the grapple attachment extends outward beyond the jaws of the workhead to provide greater reach than the workhead.

I claim:

1. A grapple attachment for a demolition shear that permits the demolition shear to open and close a grapple comprising:

a first member having a first sleeve for extending partially around a first jaw of a demolition shear, means on said first member for engaging the first jaw to hold said member on the first jaw;

a second member having a second sleeve for extending partially around a second jaw of the demolition shear, further means on said second member for engaging the second jaw of the demolition shear to hold said second member on said second jaw of the demolition shear;

a first grapple jaw connected to said second member;

a second grapple jaw pivotally connected to said first grapple jaw; and link means connected to said first jaw and to said second grapple jaw so that movement of said first jaw of the demolition shear toward said second jaw of the demolition shear causes said second grapple jaw to pivot toward said first grapple jaw to thereby enable an operator to pick up an article between said first grapple jaw and said second grapple jaw solely through the movement of said first jaw of the demolition shear toward said second jaw of the demolition shear.

2. The grapple attachment of claim 1 wherein said first grapple jaw faces toward an operator running a demolition shear when the grapple attachment is picking an object up from a horizontal surface to thereby permit an operator to see next to said first grapple jaw before closing said first first grapple jaw and said second grapple jaw.

3. The grapple attachment of claim 2 wherein said first grapple jaw and said second grapple jaw have curved tines with tips for meeting to grasp small pieces of material.

4. The grapple attachment of claim 3 wherein said means on said first member for engaging the first jaw comprises a first pin for engaging said first jaw of a demolition shear.

5. The grapple attachment of claim 4 wherein said further means includes a second pin for engaging said second jaw of the demolition shear.

6. The grapple attachment of claim 5 wherein said first sleeve of said first member partially covers a portion of said first jaw of the demolition shear.

7. The grapple attachment of claim 5 wherein said second sleeve of said second member partially covers a portion of said second jaw of the demolition shear.

8. The grapple attachment of claim 5 wherein said first pin for engaging said first jaw and said second pin for engaging said second jaw comprise a means for retaining said grapple attachment on the demolition shear.

9. The grapple attachment of claim 5 wherein said first grapple jaw is fixedly mounted to the second jaw of the demolition shear and a limit of angular movement of said first grapple jaw is solely determined by the limit of angular movement of said first jaw.

10. The grapple attachment of claim 1 including a first jawstop bar to stop movement of said first jaw of the demolition shear toward said second jaw.

11. An attachment for the jaws of a workhead that has a first function to permit an operator to convert the workhead to a second function that is responsive to control of the workhead comprising:

a first member for engaging a first jaw of a workhead;

a second member for engaging a second jaw of the workhead;

a third jaw connected to said first member;

a fourth jaw connected to said second member; and link means connected to said first member and to said third jaw so that movement of said first jaw of the workhead toward said second jaw of the workhead causes said third jaw and said fourth jaw to close to thereby enable an operator to squeeze an article between said third jaw and said fourth jaw through the movement of said first jaw toward said second jaw of the workhead.

12. The attachment of claim 11 including: a hydraulically operated workhead, said hydraulically operated workhead having a hydraulic cylinder for opening and closing the jaws of said hydraulically operated workhead.

13. The method of grasping and lifting an article with a demolition shear having a stationary jaw and a movable jaw for cutting material comprising the steps of:

connecting a second grapple jaw to the movable cutting jaw of a demolition shear;

connecting a first grapple jaw to the stationary jaw of the demolition shear to thereby convert the demolition shear to a grapple attachment; and bringing the movable cutting jaw of the demolition shear toward the stationary jaw of the demolition shear to thereby close said first grapple jaw and said second grapple jaw about an article located between said first grapple jaw and said second grapple jaw to thereby enable an operator to lift and grasp an article without cutting the article.

14. The method of claim 13 including the step of inserting the movable jaw of a demolition shear into a sleeve connected to the first grapple jaw.

15. The method of claim 13 including the step of inserting a pin into a sleeve connected to to the first grapple jaw to permit a user to quickly connect the first grapple jaw to the sleeve.

* * * * *